US011692429B2

(12) United States Patent
Egbe

(10) Patent No.: US 11,692,429 B2
(45) Date of Patent: Jul. 4, 2023

(54) SMART CALIPER AND RESISTIVITY IMAGING LOGGING-WHILE-DRILLING TOOL (SCARIT)

(71) Applicant: Saudi Arabian Oil Company, Dhahran (SA)

(72) Inventor: Peter Ido Egbe, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/512,913

(22) Filed: Oct. 28, 2021

(65) Prior Publication Data

US 2023/0140761 A1 May 4, 2023

(51) Int. Cl.
*E21B 47/002* (2012.01)
*E21B 47/08* (2012.01)

(52) U.S. Cl.
CPC ..... *E21B 47/0025* (2020.05); *E21B 47/08* (2013.01)

(58) Field of Classification Search
CPC ..... E21B 47/0025; E21B 47/08
See application file for complete search history.

(56) References Cited

U.S. PATENT DOCUMENTS 6,427,530 B1 8/2002 Krueger et al.
6,585,045 B2 7/2003 Lee et al.
7,389,828 B2 * 6/2008 Ritter ..... E21B 47/085 181/104
7,757,784 B2 7/2010 Fincher et al.
2006/0070433 A1 * 4/2006 Fredette ..... E21B 47/085 73/152.58
2010/0108386 A1 * 5/2010 Martinez ..... E21B 47/08 175/45
2012/0192640 A1 8/2012 Minh et al.
2014/0083771 A1 * 3/2014 Clark ..... E21B 10/32 175/40
2022/0003043 A1 * 1/2022 Nanayakkara ..... E21B 47/06

* cited by examiner

*Primary Examiner* — Tara Schimpf
*Assistant Examiner* — Yanick A Akaragwe
(74) *Attorney, Agent, or Firm* — Fish & Richardson P.C.

(57) ABSTRACT

Systems and methods include a system for deploying and using a customized logging-while-drilling (LWD) tool. A command is provided by a tool control system to a mechanical drive of a LWD tool to cause pads and caliper fingers of the LWD tool to extend radially, lock in place using a locking mechanism, and begin to capture downhole measurements while the LWD tool is deployed in a borehole of a well. Pressure pulse cycles produced by a series of distinct high and low flow rates by the tool control system are provided to create pulses to be detected downhole by pressure transducers. A measurement sequence for caliper and resistivity images is triggered by the tool control system. The measurement sequence is terminated by the tool control system to conserve energy.

20 Claims, 5 Drawing Sheets

SMART CALIPER AND RESISTIVITY IMAGING LOGGING-WHILE-DRILLING TOOL (SCARIT)

TECHNICAL FIELD

The present disclosure applies to capturing measurements while drilling, such as while drilling an oil well.

BACKGROUND

Typically, in the petroleum industry, particularly with oil wells, a dedicated logging trip (for example, not performed while drilling) is executed on drill pipe or wireline conveyance to obtain mechanical caliper and resistivity image logs. For example, reservoir engineers may request additional logs for fracture identification, such as if loss circulation is encountered while drilling in the reservoir section. In some cases, logs may be required even though full circulation was achieved in the reservoir section. In either case, the process for obtaining additional logs typically requires pulling out of hole (POOH) with the drilling bottom hole assembly (BHA). Then, a dedicated reaming trip is executed before picking up (P/U) and running-in-hole (RIH) with the logging tools either on wireline or drill pipe, for example, if well deviation exceeds a typical inclination range of 40-60 degrees. Such additional trips and logging tools increase overall well costs and delivery time.

SUMMARY

The present disclosure describes techniques that can be used for deploying and using a customized logging-while-drilling (LWD) tool. In some implementations, a computer-implemented method includes the following. A command is provided by a tool control system to a mechanical drive of a logging-while-drilling (LWD) tool to cause pads and caliper fingers of the LWD tool to extend radially, lock in place using a locking mechanism, and begin to capture downhole measurements while the LWD tool is deployed in a borehole of a well. Pressure pulse cycles produced by a series of distinct high and low flow rates by the tool control system are provided to create pulses to be detected downhole by pressure transducers. A measurement sequence for caliper and resistivity images is triggered by the tool control system. The measurement sequence is terminated by the tool control system to conserve energy.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Techniques of the present disclosure can eliminate the need to pull out of hole (POOH) to acquire mechanical caliper and image logs using a dedicated wireline trip. This can reduce or eliminate the additional time and costs while providing the following benefits. Wireline logging is not required, since logging can be done with existing LWD tools. A dedicated trip prior to deploying wireline tools is not needed. There is no requirement to access the wellbore multiple times, which decreases the likelihood of potential risks associated with, for example, wellbore stability, stuck pipes, and the loss of wireline tools. Caliper and resistivity image measurements can be taken before borehole deterioration (for example, mud invasion) occurs. Measurement accuracy can be improved due to the ability to use bigger outside dimension (OD) tools for the logging. The offset between tool OD and the wellbore wall is less as compared to the wireline tools.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for logging-while-drilling (LWD) tools with the capability to make mechanical borehole caliper measurements, and resistivity imaging for fracture identification. The measurements can be made through the use of activated arms (for caliper) and high resolution imaging capability. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

A specialized tool can be developed and configured to perform mechanical borehole caliper and resistivity imaging for the purpose of fracture identification. The tool can use radio-frequency identification (RFID)-activated arms (for caliper) and RFID-activated pads for high-resolution imaging. Mechanical caliper and formation resistivity image logs can be acquired using LWD tools, eliminating the need for dedicated wireline tools and trips.

Figure 1:
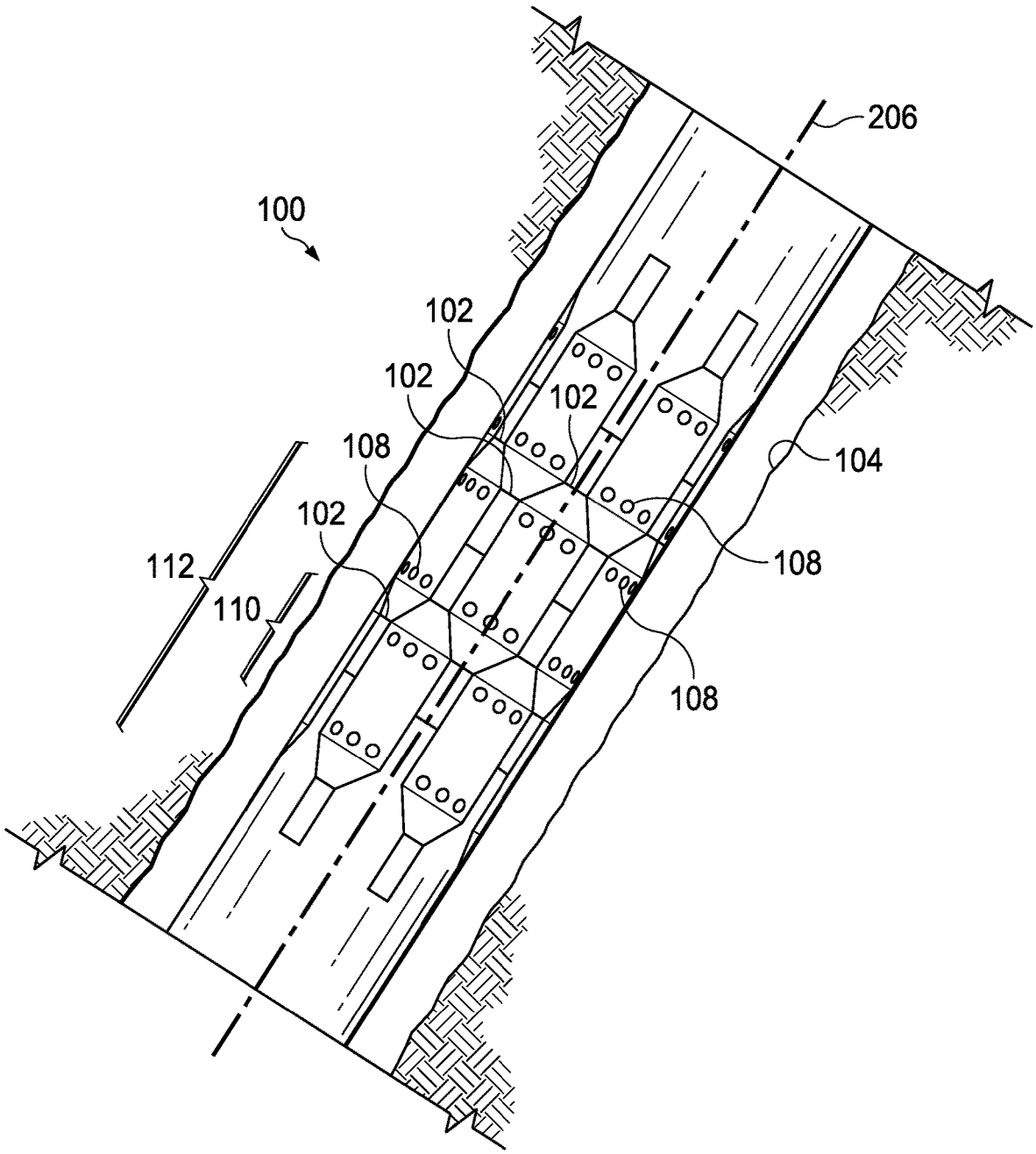
FIG. 1 is a diagram illustrating an example of a customized logging-while-drilling (LWD) tool, according to some implementations of the present disclosure.

FIGS. 1-3 collectively illustrate an example of a customized LWD tool. At a high level, the LWD tool can be configured to concurrently perform logging while drilling and downhole measurements. A tool control system can be configured to control components of the LWD tool. A system that includes the customized LWD tool includes one or more processors. The system includes a non-transitory computer-readable storage medium coupled to the one or more processors and storing programming instructions for execution by the one or more processors. The programming instructions instruct the one or more processors to perform operations including the following. A command is provided by the tool control system to a mechanical drive to cause pads and caliper fingers of the LWD tool to extend radially, lock in place using a locking mechanism, and begin to capture the downhole measurements while the LWD tool is deployed in a borehole of a well. Pressure pulse cycles produced by a series of distinct high and low flow rates are provided by the tool control system to produce pulses to be detected downhole by pressure transducers. A measurement sequence for caliper and resistivity images is triggered by the tool control system. The measurement sequence is terminated by the tool control system, to conserve energy.

FIG. 1 is a diagram illustrating an example of a customized LWD tool 100, according to some implementations of the present disclosure. The customized LWD tool 100 includes swiveled joints 102 configured to allow portions of the customized LWD tool 100 to swivel out toward a wellbore wall 104. Buttons 108 on the customized LWD tool 100 can provide a function for acquiring resistivity imaging after the customized LWD tool 100 has been deployed. Pads 110 include the customized portions of the customized LWD tool 100, including providing a location for housing the buttons. Pad faces of pads 112 are extendable outward from a drillstring on a longitudinal axis 206. The buttons 108 on the pad faces of pads 112 can perform the resistivity imaging done by the customized LWD tool 100.

Figure 2A:
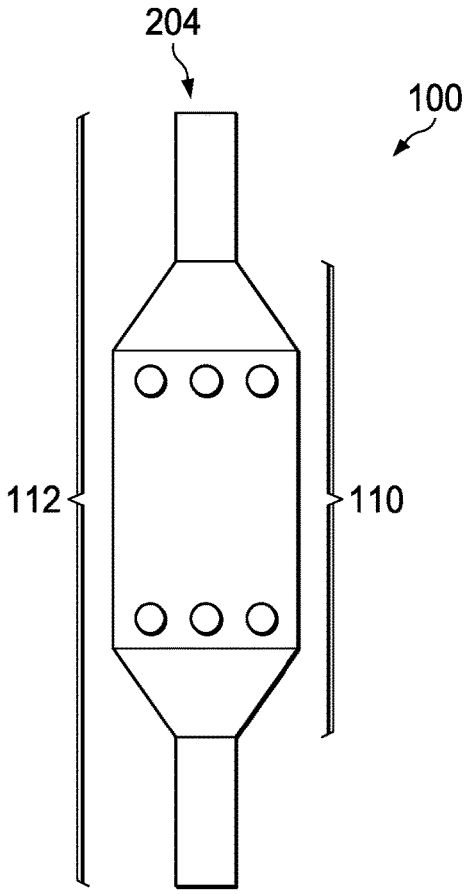
FIGS. 2A and 2B are diagrams collectively illustrating an example of a pad on the customized LWD tool in a radially extended state, according to some implementations of the present disclosure.
Figure 2B:
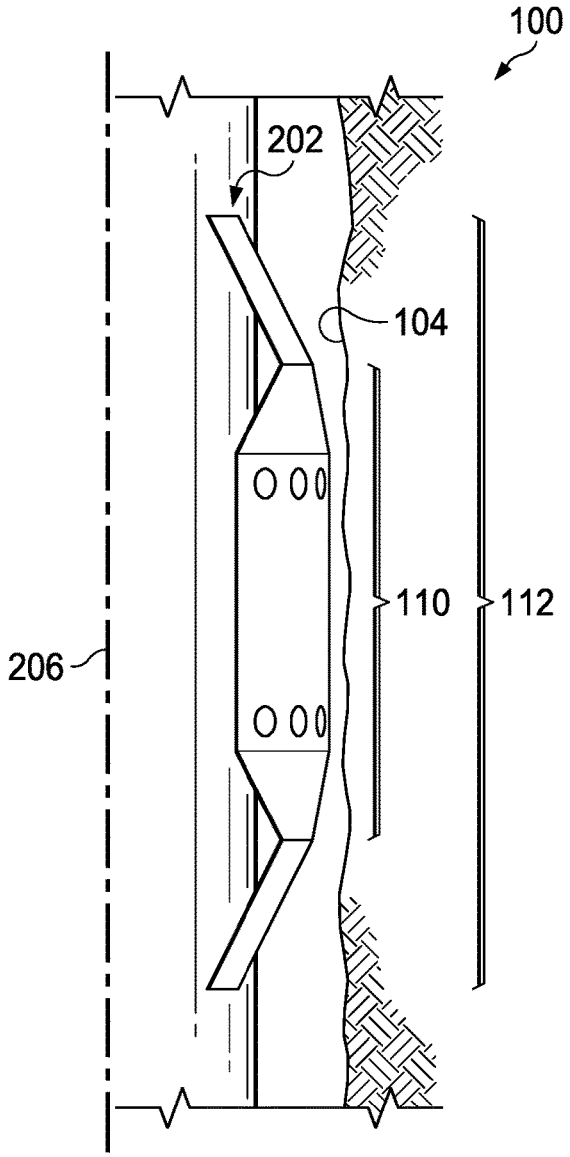

FIGS. 2A and 2B are diagrams collectively illustrating an example of a pad 112 on the customized LWD tool 100 in a radially extended state 202, according to some implementations of the present disclosure. The customized LWD tool 100 shown in the radially extended state 202 is depicted next to the customized LWD tool 100 in a non-extended state 202. The customized LWD tool 100 is centered along the longitudinal axis 206, representing a center of a drillstring, for example, on which the customized LWD tool 100 is mounted.

Figure 3A:
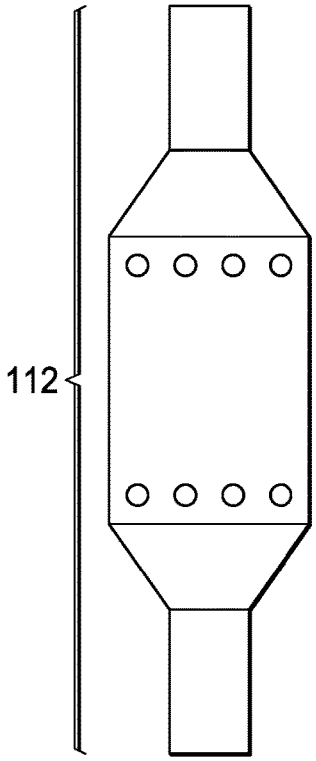
FIGS. 3A and 3B are diagrams collectively illustrating an example of the customized LWD tool, according to some implementations of the present disclosure.
Figure 3B:
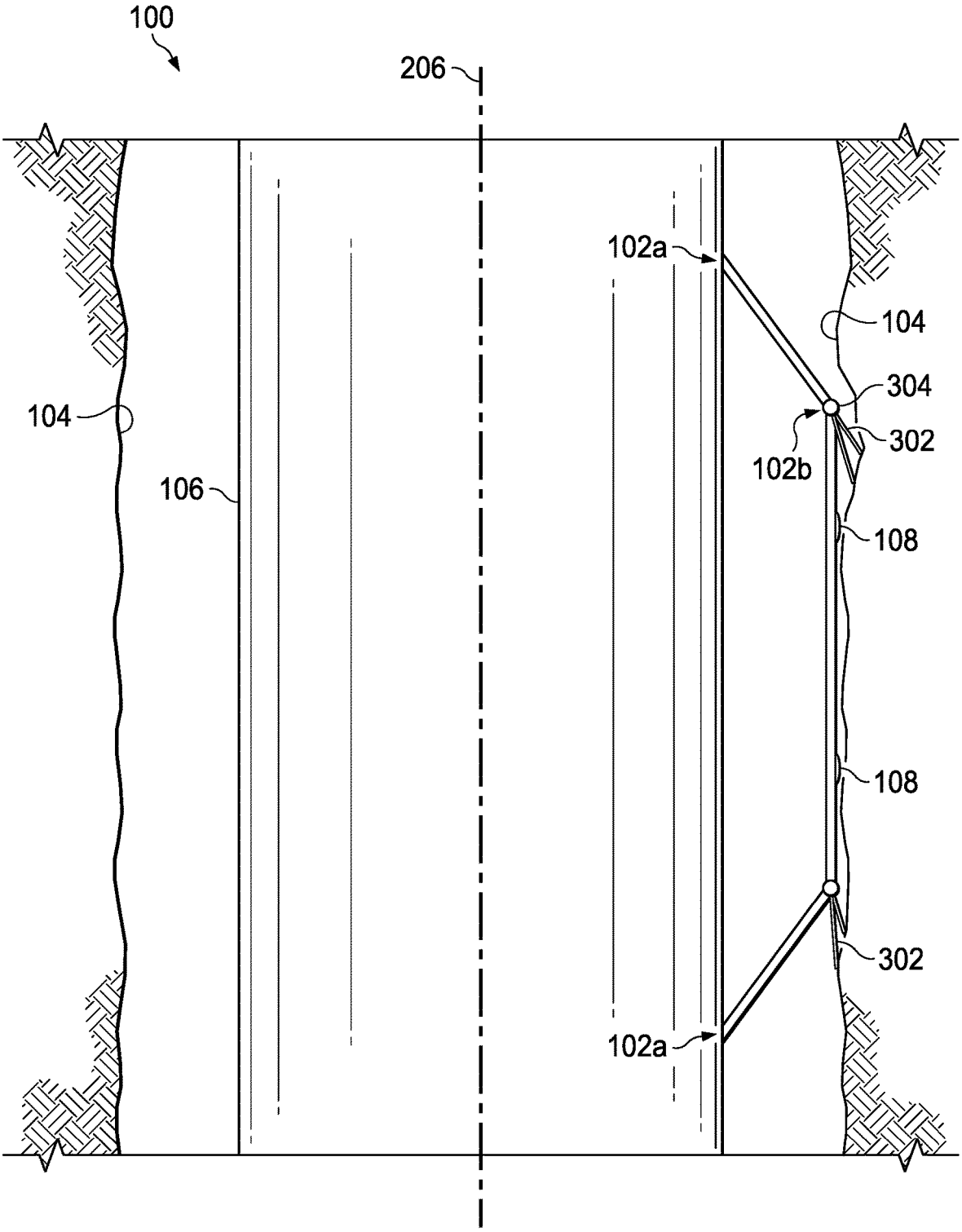

FIGS. 3A and 3B are diagrams collectively illustrating an example of the customized LWD tool 100, according to some implementations of the present disclosure. The side view in FIG. 3A shows the pad 112 of the customized LWD tool 100 in the radially extended state 202. Swiveled joints 102 shown in FIG. 3B allow the pad 112 to extend (outward from the longitudinal axis 206 and the customized LWD tool 100) and then retract, and to align to the wellbore wall 104. Mechanical caliper fingers 302 (or caliper arms) extended from each pad 112 of the customized LWD tool 100 can measure the borehole size along the wellbore wall 104. Roller mechanisms 304 along the edges of the customized LWD tool 100 can reduce friction caused by the customized LWD tool 100 contacting the wellbore wall 104.

In some implementations, the arms and pads can be flush and embedded within a chamber (for example, enclosed by a chamber door) in the customized LWD tool 100. The customized LWD tool 100 can perform as an otherwise conventional LWD tool until the section of the well is drilled to a predetermined depth. At the predetermined depth, signals can be sent from the well surface to the customized LWD tool to open the chamber door, and to activate the arms and pads. High-resolution electro-acoustic signals can be sent from the surface using RFID technology. Once activated, the arms and pads can unfold out of the chamber. The arms and pads can include rollers at the elbows of the unfolded joints to ease friction, facilitating mechanical caliper measurements. The arms and pads can also be designed and configured to be sensitive enough to measure the undulating profile of the borehole, including the wellbore wall 104. To achieve this, articulated caliper fingers 302 (or probes) can extend above or below the rollers, preferably below the rollers. The caliper fingers 302 can provide the sensitivity required to measure the borehole variation as the customized LWD tool is pulled from the hole. Several of the arms can exist radially on the customized LWD tool, for example, offset at a depth on the longitudinal axis 206 of the customized LWD tool. 100 A locking mechanism can be incorporated to ensure that the arms stay extended once the arms are activated, preventing collapse due to the weight of the bottom hole assembly (BHA).

In some implementations, 4-6 arms can be included in the measuring station. Each measurement station can be offset from a previous measurement station to ensure that the entire circumference of the borehole is measured. The offset arrangements can be configured such that a plan view from the top of the customized LWD tool reveals a basket-like structure, with each measurement arm representing a sector of a circle. As such, some implementations can use up to 16 sectors.

After the caliper fingers 302 deploy, an array of high-resolution electro-acoustic measurement buttons on the pads can be used for data acquisition when the caliper fingers 302 are unfolded. The measurement buttons can be installed on pads, which can push out radially from the longitudinal axis 206 of the customized LWD tool 100. The customized LWD tool 100 can have the ability to acquire a data density of several data points per foot to achieve an equal or greater accuracy compared with conventional wireline tools.

The customized LWD tool can be deployed in an upward direction, pulling out of hole. The customized LWD tool can have the capability to fold and unfold the caliper fingers 302 and pads multiple times. As a result, the customized LWD tool can be activated as many times as required.

In some implementations, dedicated lithium batteries can be used to power the customized LWD tool while in caliper/resistivity imaging mode. The batteries can be designed to last for several days, and can be rechargeable with a mud-flow while the customized LWD tool is functioning in LWD mode. During caliper/resistivity imaging mode, rotation of the customized LWD tool can be prevented to avoid damaging the unfolded arms.

In some implementations, a method of activation of the caliper fingers 302 and electro-acoustic sensor can include the following. The caliper fingers 302 and pads will be activated by use of RFID devices. A mechanical drive can be used to cause the arms and pads to extend radially and be locked with a locking mechanism before performing the downhole measurements. Pressure pulse cycles created by a series of distinct high/low flow rates can provide pulses to be detected downhole by pressure transducers connected to a pre-programmed downhole RFID device. In addition, measurement-while-drilling (MWD) or LWD tools can be used to detect the same pressure cycles. The tools can subsequently initiate a command to activate the mechanical drive to perform the same function that otherwise would be initiated by an RFID tag. RFID tag activation can be the primary way to perform activation, while pressure cycling can provide a back-up for activating the arms and pads. De-activation of the arms and pads can be accomplished using RFID technology and/or pressure pulses.

After the arms and pads have been activated, a circuit switch embedded in the tool can trigger the measurement sequence for both the caliper and resistivity images. When the arms and pads are activated in a closed state, the same circuit switch can turn off the measurement sequence in order to conserve energy.

In some implementations, an embedded system switch can be added to the customized LWD tool and configured to perform self-diagnosis. For example, a diagnosis can be made: 1) if the arms and pads are not fully extended, 2) if there is insufficient tool power to execute the measurement sequence, 3) whether adjustments are needed for downhole temperature measurement (for example, to adjust for downhole data acquisition rates and quality assurance/quality check (QA/QC) reasons.

In some implementations, the caliper fingers 302 and pads for resistivity imaging can reside in the same chamber. In some implementations, the caliper fingers 302 and pads for resistivity imaging can be compartmentalized and reside in separate chambers if that design is deemed more robust. If the caliper fingers 302 and pads are housed in the same chamber, a deployment and collapse sequence can ensure that the arms deploy first followed by the pads. In collapse mode, the pads can retreat first into the chamber, followed by the caliper fingers 302.

Although a mechanism can be incorporated to ensure the arms and pads stay radially extended when activated, the locking mechanism can be rated to withstand a maximum over-pull. When an over-pull threshold is exceeded, the arms and pads can collapse as a safety mechanism to avoid potential damage (for example, breakage) of the arms and pads, which may lead to unplanned fishing operations. The tool design can be such that drilling fluid invasion is avoided, or at least that fluid invasion does not impact the tool functionality.

Figure 4:
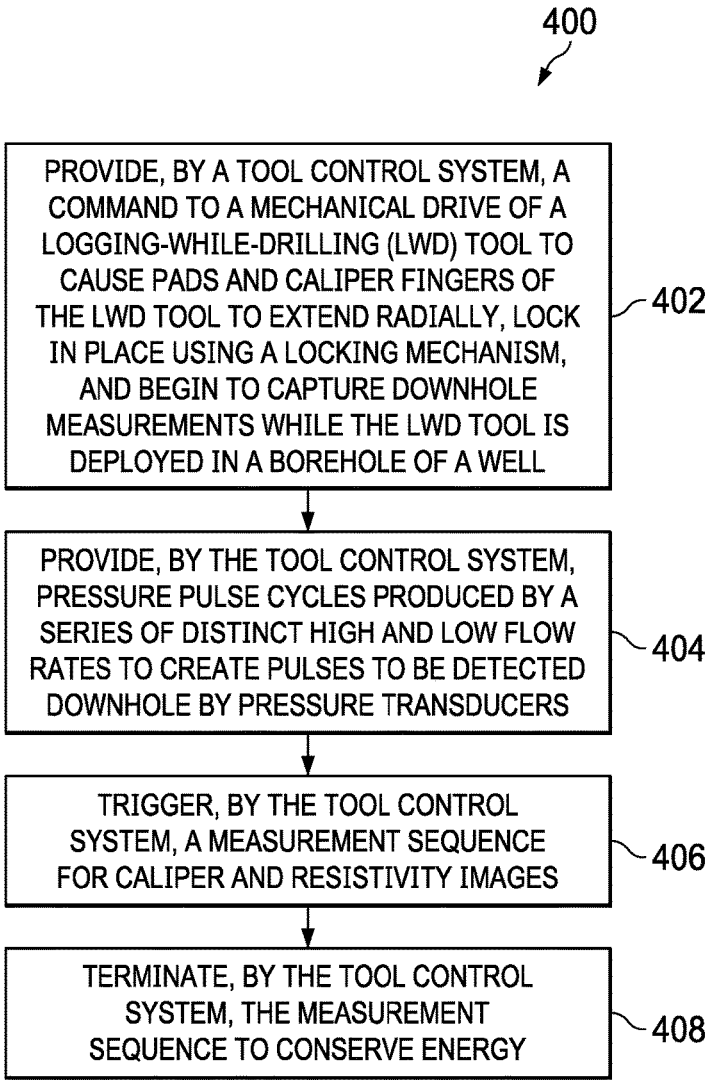
FIG. 4 is a flowchart of an example of a method for deploying and using a customized LWD tool, according to some implementations of the present disclosure.

FIG. 4 is a flowchart of an example of a method 400 for deploying and using a customized LWD tool, according to some implementations of the present disclosure. For clarity of presentation, the description that follows generally describes method 400 in the context of the other figures in this description. However, it will be understood that method 400 can be performed, for example, by any suitable system, environment, software, and hardware, or a combination of systems, environments, software, and hardware, as appropriate. In some implementations, various steps of method 400 can be run in parallel, in combination, in loops, or in any order.

At 402, a command is provided by a tool control system to a mechanical drive of a logging-while-drilling (LWD) tool (for example, the customized LWD tool 100) to cause pads and caliper fingers of the LWD tool to extend radially, lock in place using a locking mechanism, and begin to capture downhole measurements while the LWD tool is deployed in a borehole of a well. The tool control system can be at the surface of an oil well, for example. In some implementations, providing the command includes using radio frequency identification (RFID) communication. From 402, method 400 proceeds to 404.

The tool can be lowered into a wellbore, for example. In some implementations, the LWD tool further includes rollers (for example, roller mechanisms 304) configured to roll adjacent to a wellbore wall to reduce friction between the LWD tool and the wellbore wall of a wellbore while the LWD tool travels through the wellbore. The LWD tool can further include buttons (for example, buttons 108) for acquiring resistivity images.

At 404, pressure pulse cycles produced by a series of distinct high and low flow rates by the tool control system are provided to create pulses to be detected downhole by pressure transducers. The pulses can be separated by a predetermine time function. From 404, method 400 proceeds to 406.

At 406, a measurement sequence for caliper and resistivity images is triggered by the tool control system. The caliper fingers (for example caliper fingers 302) can be configured to measure a size of the borehole, for example. The LWD tool further includes swiveled joints (for example, swivel joints 102) configured to extend and retract the pads. From 406, method 400 proceeds to 408.

At 408, the measurement sequence is terminated by the tool control system to conserve energy. For example, the tool control system can send a command using RFID technology. After 408, method 400 can stop.

In some implementations, in addition to (or in combination with) any previously-described features, techniques of the present disclosure can include the following. Customized user interfaces can present intermediate or final results of the above described processes to a user. The presented information can be presented in one or more of textual, tabular, or graphical format, such as through a dashboard. The information can be presented at one or more of on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change or an improvement in drilling parameters (including speed and direction) or overall production of a gas or oil well. The suggestions, when implemented by the user, can improve the speed and accuracy of calculations, streamline processes, improve models, and solve problems related to efficiency, performance, safety, reliability, costs, downtime, and the need for human interaction. In some implementations, the suggestions can be implemented in real-time, such as to provide an immediate or near-immediate change in operations or in a model. The term real-time can correspond, for example, to events that occur within a specified period of time, such as within one minute or within one second. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 5:
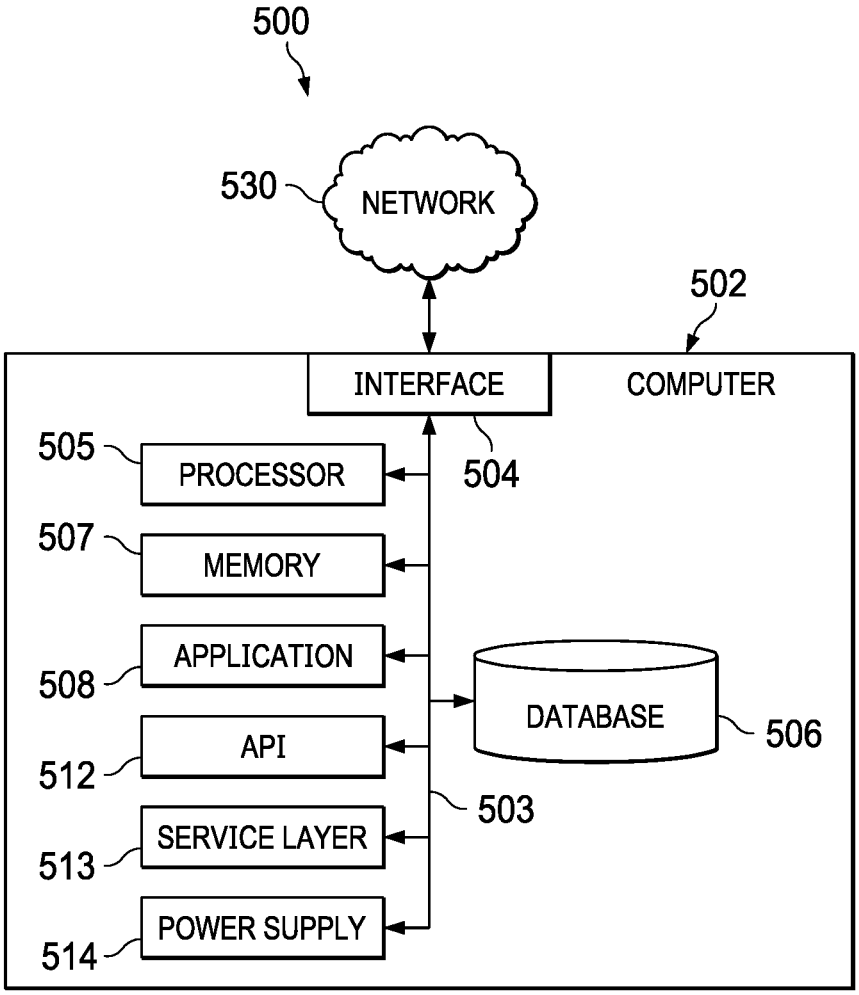
FIG. 5 is a block diagram illustrating an example computer system used to provide computational functionalities associated with described algorithms, methods, functions, processes, flows, and procedures as described in the present disclosure, according to some implementations of the present disclosure.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a top level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 503. In some implementations, any or all of the components of the computer 502, including hardware or software components, can interface with each other or the interface 504 (or a combination of both) over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 508 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Described implementations of the subject matter can include one or more features, alone or in combination.

For example, in a first implementation, a computer-implemented system includes a logging-while-drilling (LWD) tool configured to concurrently perform logging while drilling and downhole measurements. The system also includes a tool control system configured to control components of the LWD tool. The system further includes one or more processors and a non-transitory computer-readable storage medium. The non-transitory computer-readable storage medium is coupled to the one or more processors and stores programming instructions for execution by the one or more processors. The programming instructions instruct the one or more processors to perform operations including the following. A command is provided by the tool control system to a mechanical drive to cause pads and caliper fingers of the LWD tool to extend radially, lock in place using a locking mechanism, and begin to capture the downhole measurements while the LWD tool is deployed in a borehole of a well. Pressure pulse cycles produced by a series of distinct high and low flow rates are provided by the tool control system to produce pulses to be detected downhole by pressure transducers. A measurement sequence for caliper and resistivity images is triggered by the tool control system. The measurement sequence is terminated by the tool control system to conserve energy.

The foregoing and other described implementations can each, optionally, include one or more of the following features:

A first feature, combinable with any of the previous or following features, where providing the command includes using radio frequency identification (RFID) communication.

A second feature, combinable with any of the previous or following features, where the tool control system is at the surface of an oil well.

A third feature, combinable with any of the previous or following features, where the LWD tool further includes rollers configured to roll adjacent to a wellbore wall to reduce friction between the LWD tool and the wellbore wall of a wellbore while the LWD tool travels through the wellbore.

A fourth feature, combinable with any of the previous or following features, where the LWD tool further includes buttons for acquiring resistivity images.

A fifth feature, combinable with any of the previous or following features, where the caliper fingers are configured to measure a size of the borehole.

A sixth feature, combinable with any of the previous or following features, where the LWD tool further includes swiveled joints configured to extend and retract the pads.

In a second implementation, a computer-implemented method includes the following. A command is provided by a tool control system to a mechanical drive of a logging-while-drilling (LWD) tool to cause pads and caliper fingers of the LWD tool to extend radially, lock in place using a locking mechanism, and begin to capture downhole measurements while the LWD tool is deployed in a borehole of a well. Pressure pulse cycles produced by a series of distinct high and low flow rates by the tool control system are provided to create pulses to be detected downhole by pressure transducers. A measurement sequence for caliper and resistivity images is triggered by the tool control system. The measurement sequence is terminated by the tool control system to conserve energy.

The foregoing and other described implementations can each, optionally, include one or more of the following features:

A first feature, combinable with any of the following features, where providing the command includes using radio frequency identification (RFID) communication.

A second feature, combinable with any of the previous or following features, where the tool control system is at the surface of an oil well.

A third feature, combinable with any of the previous or following features, where the LWD tool further includes rollers configured to roll adjacent to a wellbore wall to reduce friction between the LWD tool and the wellbore wall of a wellbore while the LWD tool travels through the wellbore.

A fourth feature, combinable with any of the previous or following features, where the LWD tool further includes buttons for acquiring resistivity images.

A fifth feature, combinable with any of the previous or following features, where the caliper fingers are configured to measure a size of the borehole.

A sixth feature, combinable with any of the previous or following features, where the LWD tool further includes swiveled joints configured to extend and retract the pads.

In a third implementation, a non-transitory, computer-readable medium stores one or more instructions executable by a computer system to perform operations including the following. A command is provided by a tool control system to a mechanical drive of a logging-while-drilling (LWD) tool to cause pads and caliper fingers of the LWD tool to extend radially, lock in place using a locking mechanism, and begin to capture downhole measurements while the LWD tool is deployed in a borehole of a well. Pressure pulse cycles produced by a series of distinct high and low flow rates by the tool control system are provided to create pulses to be detected downhole by pressure transducers. A measurement sequence for caliper and resistivity images is triggered by the tool control system. The measurement sequence is terminated by the tool control system to conserve energy.

The foregoing and other described implementations can each, optionally, include one or more of the following features:

A first feature, combinable with any of the following features, where providing the command includes using radio frequency identification (RFID) communication.

A second feature, combinable with any of the previous or following features, where the tool control system is at the surface of an oil well.

A third feature, combinable with any of the previous or following features, where the LWD tool further includes rollers configured to roll adjacent to a wellbore wall to reduce friction between the LWD tool and the wellbore wall of a wellbore while the LWD tool travels through the wellbore.

A fourth feature, combinable with any of the previous or following features, where the LWD tool further includes buttons for acquiring resistivity images.

A fifth feature, combinable with any of the previous or following features, where the caliper fingers are configured to measure a size of the borehole.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented system, comprising:

a logging-while-drilling (LWD) tool configured to concurrently perform logging while drilling and downhole measurements;

a tool control system configured to control components of the LWD tool;

one or more processors; and a non-transitory computer-readable storage medium coupled to the one or more processors and storing programming instructions for execution by the one or more processors, the programming instructions instructing the one or more processors to perform operations comprising:

providing, by the tool control system, a command to cause pads and caliper fingers of the LWD tool to extend radially, lock in place, and begin to capture the downhole measurements while the LWD tool is deployed in a borehole of a well;

providing, by the tool control system, pressure pulse cycles produced by a series of distinct high and low flow rates to produce pulses to be detected downhole;

triggering, by the tool control system, a measurement sequence for caliper and resistivity images; and terminating, by the tool control system, the measurement sequence to conserve energy.

2. The computer-implemented system of claim 1, wherein providing the command includes using radio frequency identification (RFID) communication.

3. The computer-implemented system of claim 1, wherein the tool control system is at the surface of an oil well.

4. The computer-implemented system of claim 1, wherein the LWD tool further comprises rollers configured to roll adjacent to a wellbore wall to reduce friction between the LWD tool and the wellbore wall of a wellbore while the LWD tool travels through the wellbore.

5. The computer-implemented system of claim 1, wherein the LWD tool further comprises buttons for acquiring resistivity images.

6. The computer-implemented system of claim 1, wherein the caliper fingers are configured to measure a size of the borehole.

7. The computer-implemented system of claim 1, wherein the LWD tool further comprises swiveled joints configured to extend and retract the pads.

8. A computer-implemented method, comprising:

providing, by a tool control system, a command to a logging-while-drilling (LWD) tool to cause pads and caliper fingers of the LWD tool to extend radially, lock in place, and begin to capture downhole measurements while the LWD tool is deployed in a borehole of a well;

providing, by the tool control system, pressure pulse cycles produced by a series of distinct high and low flow rates to create pulses to be detected downhole;

triggering, by the tool control system, a measurement sequence for caliper and resistivity images; and terminating, by the tool control system, the measurement sequence to conserve energy.

9. The computer-implemented method of claim 8, wherein providing the command includes using radio frequency identification (RFID) communication.

10. The computer-implemented method of claim 8, wherein the tool control system is at the surface of an oil well.

11. The computer-implemented method of claim 8, wherein the LWD tool further comprises rollers configured to roll adjacent to a wellbore wall to reduce friction between the LWD tool and the wellbore wall of a wellbore while the LWD tool travels through the wellbore.

12. The computer-implemented method of claim 8, wherein the LWD tool further comprises buttons for acquiring resistivity images.

13. The computer-implemented method of claim 8, wherein the caliper fingers are configured to measure a size of the borehole.

14. The computer-implemented method of claim 8, wherein the LWD tool further comprises swiveled joints configured to extend and retract the pads.

15. A non-transitory, computer-readable medium storing one or more instructions executable by a computer system to perform operations comprising:

providing, by a tool control system, a command to a logging-while-drilling (LWD) tool to cause pads and caliper fingers of the LWD tool to extend radially, lock in place, and begin to capture downhole measurements while the LWD tool is deployed in a borehole of a well;

providing, by the tool control system, pressure pulse cycles produced by a series of distinct high and low flow rates to create pulses to be detected downhole;

triggering, by the tool control system, a measurement sequence for caliper and resistivity images; and terminating, by the tool control system, the measurement sequence to conserve energy.

16. The non-transitory, computer-readable medium of claim 15, wherein providing the command includes using radio frequency identification (RFID) communication.

17. The non-transitory, computer-readable medium of claim 15, wherein the tool control system is at the surface of an oil well.

18. The non-transitory, computer-readable medium of claim 15, wherein the LWD tool further comprises rollers configured to roll adjacent to a wellbore wall to reduce friction between the LWD tool and the wellbore wall of a wellbore while the LWD tool travels through the wellbore.

19. The non-transitory, computer-readable medium of claim 15, wherein the LWD tool further comprises buttons for acquiring resistivity images.

20. The non-transitory, computer-readable medium of claim 15, wherein the caliper fingers are configured to measure a size of the borehole.

* * * * *